United States Patent [19]

Ayroldi

[11] 4,224,162

[45] Sep. 23, 1980

[54] APPARATUS FOR COLLECTING LIQUIDS AND/OR SLIMES FLOATING ON LIQUID SURFACES

[76] Inventor: Giuseppe Ayroldi, Piazza Mincio 4, Roma, Italy

[21] Appl. No.: 39,597

[22] Filed: May 16, 1979

[30] Foreign Application Priority Data

May 16, 1978 [IT] Italy ..... 49410 A/78

[51] Int. Cl.[3] ..... E02B 15/04

[52] U.S. Cl. ..... 210/242 R; 210/923; 210/411

[58] Field of Search ..... 210/83, 242, DIG. 25, 210/82, 411

[56] References Cited

U.S. PATENT DOCUMENTS

| | | | |
|---|---|---|---|
| 3,534,859 | 10/1970 | Amero et al. | 210/242 S |
| 3,690,463 | 9/1972 | O'Brien | 210/242 S |
| 3,722,688 | 3/1973 | Wirsching | 210/DIG. 25 |
| 3,722,689 | 3/1973 | Markel et al. | 210/DIG. 25 |
| 3,753,496 | 8/1973 | Boyd | 210/DIG. 25 |
| 3,753,497 | 8/1973 | Hoffman | 210/DIG. 25 |
| 3,800,951 | 4/1974 | Mourlon et al. | 210/DIG. 25 |
| 3,909,416 | 9/1975 | In't Veld | 210/DIG. 25 |
| 4,024,063 | 5/1977 | Mor | 210/242 R |

*Primary Examiner*—Theodore A. Granger
*Attorney, Agent, or Firm*—Staas & Halsey

[57] ABSTRACT

Apparatus for separating and removing, exclusively by mechanical means, a polluting liquid or slimes floating on water or another liquid not miscible with the polluting substance and comprising:

a flexible floating platform of a specific gravity less than that of the water, at the center of which is mounted a suction device provided with at least a lower suction pipe the platform having a plurality of channels with entrance orifices arranged on the periphery thereof and provided with a weir sill, the or each suction pipe being connected, through a flexible pipe, to a pumping unit mounted on a remote fixed or floating supporting means.

7 Claims, 5 Drawing Figures

APPARATUS FOR COLLECTING LIQUIDS AND/OR SLIMES FLOATING ON LIQUID SURFACES

The present invention relates to an apparatus for collecting, exclusively by mechanical means, liquid or slimy polluting fluids floating on liquid surfaces, also on open sea. The apparatus includes a flexible platform freely floating on the liquid surface water, for instance, platform which is connected by flexible pipes to a pumping unit which can be mounted ashore, on a raft, or on a boat or lighter according to the circumstances.

It is known that the pollution of the water of rivers, lakes and seas is due in large part to factors connected to the production, transport and utilisation of hydrocarbons, which can be caused either by almost inevitable operative occurrences, as, for instance, the discharge into the sea of brunt hydrocarbons, the more or less abusive discharges of bilge waters or of ballast waters, of sewer systems, or by casual events, such as collisions or stranding of oil-tankers, breakages of valves or pipes, or by manoeuvre errors during the loading or unloading operations of these ships.

Means have not hitherto been provided, which are adapted in order to prevent or to find at least a partial remedy to the "operative" pollutions, whilst the "casual" pollutions are eliminated by the spinkling on the polluted liquid surfaces of chemical substances which are noxious because of their toxicity and because of the fact that they have to operate in ambient which is already dangerously saturated in its capacity, of biological degradation. The already known mechanical recovery systems and apparatus are scarcely efficient and very expensive.

In contrast, the apparatus of the invention is little expensive in its construction and operation; it is very adaptable to different operative conditions and it is also capable of operating at very high efficiency levels and it can easily adapt itself to the ambient conditions, in which it must operate. The special flexible structure of the floating platform enables that this latter fits itself to a large range of different operative conditions, such as rain, surf and, in particular, to the continuous variability of the wave-motion.

Owing to these specific characteristics, this apparatus can be advantageously used as permanent system for removing pollutions from water surfaces which are due to industrial activities as well as for removing from the surfaces, also on open sea, large oily spots of "casual" origin.

Figure 1:
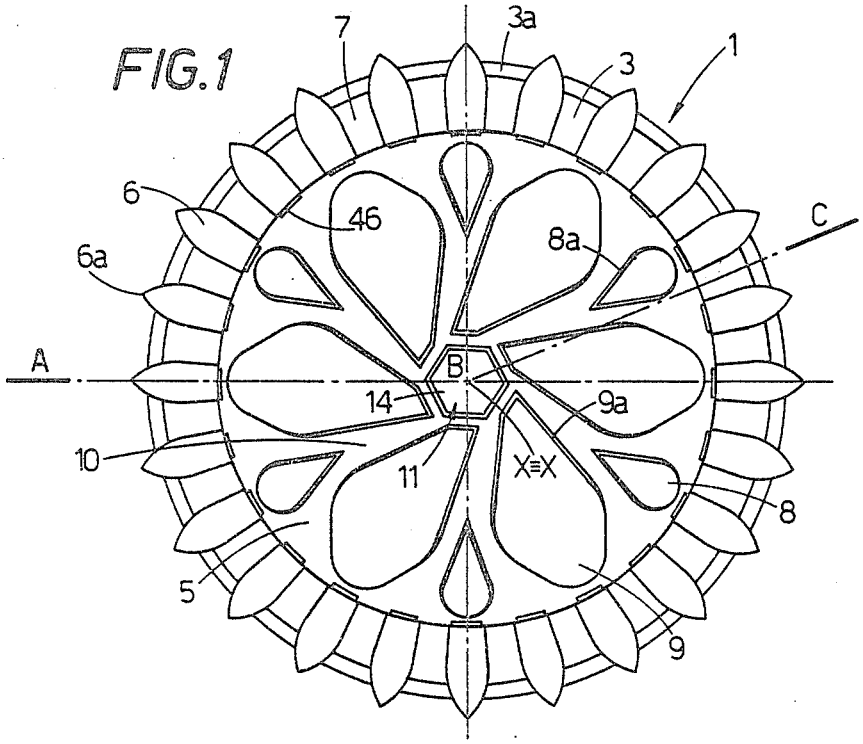
Figure 2:
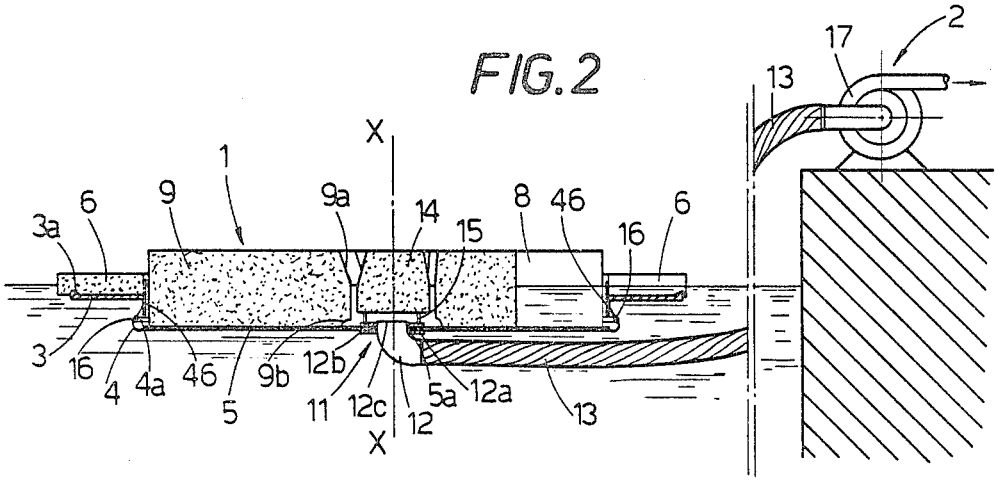
Figure 3:
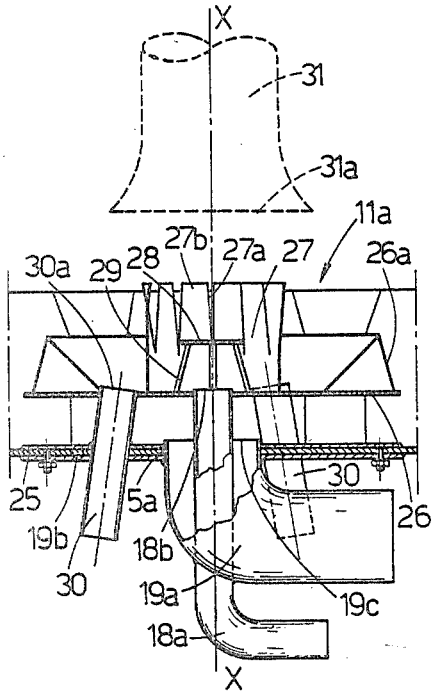
Figure 4:
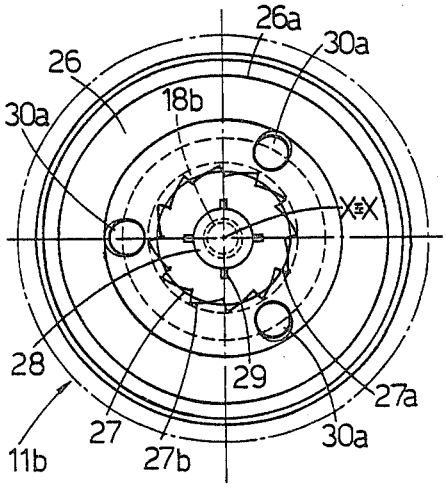
Figure 5:
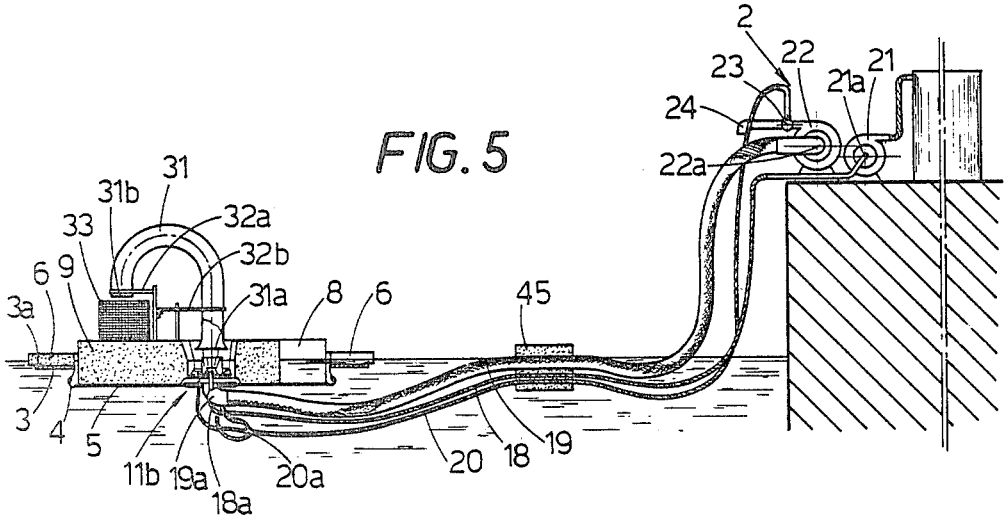

These and other characteristics of the invention will be better understood from the following description of two embodiments of the invention, taken in consideration together with the accompanying drawings, in which:

FIGS. 1 and 2 shown a top view and a section taken on the line A-B-C of FIG. 1 respectively of a first embodiment of the floating platform which is the main part of the apparatus;

FIGS. 3 and 4 show a variant of the suction device mounted in the centre of the platform and represented in an axial sectional view and in a top view respectively; and FIG. 5 shows the whole apparatus provided with the suction device of FIGS. 3 and 4 and which is diagrammatically shown in a side view, partly sectioned.

Now, referring to the drawings, the apparatus comprises, as main part, a floating platform, generally marked 1, which comprises: a peripheral annular band or flat ring 3, having a peripheral edge 3*a* extending upwards; an annular apron-like member 4 which connects said band 3 with a lower disc 5 coaxially to the axis X—X of the platform 1; a suction device fitted wholly within the central part of the platform 1; and floating bodies 6, 8 and 9, which serve also to define liquid current guiding channels.

The outer annular band 3 is made of a laminar flexible material, such as neoprene, polyurethan, polyethylene, acrylonitrilic resins, alluminium and the like and has an outer peripheral edge 3*a* of a preferably, triangular cross section, as shown in FIGS. 1 and 2, so as to form an annular weir sill about the platform 1. On the upper surface of the annular band 3 floating bodies 6 are fixed, which have the task of maintaining the annular band 3 and its sill 3*a* at a predetermined constant floatage depth which could be also made adjustable by means of weights designed to be placed into seats arranged in the floating bodies 6 and which have not been shown in the drawings; i.e. the annular band of ring 3 must remain at a very small distance underneath the water surface, while the bodies 6 mounted thereon are angularly spaced apart from each other, so as to define radial channels 7 therebetween.

From the inner edge of the annular member 3, 6 depends downwardly an annular apron-like substantially cylindrical wall member 4 made of liquid proof material and capable of being deformed. The flexible member 4 is connected to the lower central disc 5 having a diameter substantially equal to the inner diameter of the annular band 3 and which is also made of flexible material. The disc 5 is maintained at a predetermined constant depth underneath the water surface by floating bodies 8 and 9 fixed on the upper surface thereof and which define oriented channels 10 therebetween. The annular member 3, 6, as well as the central disc 5, have been made of flexible material so as to enable the platform 1 to bend along the channels 7 and 10 at each change of the form of the liquid surface on which the apparatus must operate.

Now, the characteristics of the platform 1 are considered in a more detailed manner, and, more in particular, are considered the characteristics of the bodies 6 mounted on the annular band 3. The main task of the structures 3, 6 is that of maintaining the band 3 and the sill 3*a* at a predetermined depth underneath the water surface.

In order to attain such a purpose, it is sufficient that one suitably calculates the average specific gravity of the annular member 3, 6 which has to be obviously always less than 1 g/cm$^3$; in this calculation the weight of the water, present in the channels 7 in rest condition of the platform 1 is not considered. But when under the effect of pumping and owing to the presence of the sill 3*a*, a weir will be created, the thickness of the fluid nappe moving through the channels 7 will be subjected to contraction, so that a drecrease, of the weight of the water acting on the annular member 3, 6 is produced so that a lifting of the waterline of this annular member 3, 6 occurs, which is proportional to the contraction.

As a result thereof, a further contraction of the fluid nappe will be produced and, therefore, a further lifting of the waterline of the annular member 3, 6 and so on, up to a possible complete emersion of the sill 3*a* over the water surface and consequently up to the final stopping of the operative cycle of the apparatus.

In order to prevent that this stopping can take place, it is necessary to dimension the width of the bodies 6, as regards the width of the channels 7 in such a manner that the maximum of the excursion range of the floating levels of the annular member 3, 6 due to the full emptying of the channels 7 let always the sill 3*a* underneath the water-line of the water surrounding the platform.

From a mathematical standpoint, the minimum value of this ratio can be easily obtained by means of a simple calculation.

At A is indicated the average width of one of the floating bodies 6, at C the average width of a channel 7, at E the height of the sill 3*a*, at D the value of the maximum variation of the water-line of the annular member 3, 6 and at B the water-line of the member 3, 6 when the channel 7 is empty, while B+D is the value of the level of static floatage, so that the following ratios will be valid:

$$A:B=C:D$$

where the value of three of these parameters can be freely determined on the base of the results which are desired to attain, under the sole condition that B must be always greater than E. On the purpose of reducing, as far as possible, the value of the parameter D, each floating body 6 can be designed so as to occupy on the annular band 3, inplan, an area which is at its outer end portion larger than at its inner end portion.

In other words, the ratio between the width of the floating bodies 6 and that of the adjacent channels 7 must increase progressively from their outer ends towards the inner ones.

This particular configuration of the floating bodies 6 will cause that when the fluid current is being contracted along the channels 7, the gravity center line of the annular member 3, 6 will be displaced towards the outside and that will compensate at least in part owing to the consequent modification of the level of the water-line on the annular member 3,6 for the reduced immersion level due to the contraction of the fluid current in channel 7. "Gravity center line" means the line on which there are the centers of gravity of the elementary radial sectors of the annular member 3, 6 in its operative condition; i.e. in the calculation the weight of the water in the channels 7 has been also taken in consideration.

In order to further improve the tendency of the annular member 3, 6 to a self-balance, it is convenient that the bodies 6 extend beyond the peripheral edge 3, 3*a* as well as to shape the end portions 6*a* of these bodies 6 in the form of wedges, so that the center of gravity of the bodies 6 is displaced towards the outside.

This particular front tapering 6*a* of the floating bodies 6, which begins before the sill 3*a*, enables a considerable increase of the lenght of the weir sill 3*a*.

Now it will be considered the characteristics of the structure of the inner portion of platform 1.

This inner portion has the main purpose of collecting the water overflowed through the weir sill 3*a*, so as to guide it ordinately towards the central area where the suction device is positioned. Various and particularly important are the tasks accomplished by the floating bodies 8 and 9, and more in particular these latter must:

(1) Provide the buoyancy of the central portion of platform 1 and of the suction device mounted thereon, ensuring a constant correct positioning also in conditions of very rough sea:

(2) Allow the maximum flexibility of platform 1, so that this latter can be capable of suiting itself to the change of the form of the water surface when the waves pass underneath it, without adversely affecting the floating of the annular member 3,6;

(3) Define a sufficient number of inner channels 19 for guiding the overflowed water towards the central area of platform 1 where there is the suction device 1, without creating spots of dead water;

(4) Ensure a correct position of platform 1, also during the apparatus operation.

In fact, when the pumping unit 2 becomes operative, a contraction of the volume of the liquid currents within platform 1 takes place and therefore a decrease of the total weight of platform 1 which will tend to emerge on the liquid surface until a new static equilibrium condition will be attained.

Essential condition for a correct operation of this system consists in the fact that this new equilibrium condition of platform 1 after the starting of the operation of pumping unit 2, does not differ too much from the preceding one and that, however, it does not prevent or makes difficult to produce the physical feno mena on which this invention aims to take advantage.

A good solution, which advantageously and efficiently fulfils the different functional requirements which have been therebefore mentioned, is attained by shaping the floating bodies 8 and 9 according to the forms, as shown in FIG. 1.

With such a configuration the following results will be obtained:

(a) Owing to the shape of the floating bodies 8 and 9 a sufficient number of channels 10 are obtained which are well oriented along platform 1, so as to allow the liquid currents to be substantially tangentially guided towards the suction device and which are such as to permit an optimum bending of platform 1.

Moreover, in order to increase the bending capacity of platform 1, provision has been made of tapering upwardly the side surface 9*a* and 8*a* of the floating bodies 8 and 9 while in order to increase the flow rate the side surfaces of the bodies 8 and 9 have recessed lower portions 8*b*, 9*b* (the recessed parts 8*b* being not shown in the drawings).

(b) Due to the considerable dimensions of the bodies 8 and 9 (plan area and volume), the necessary high reserve of buoyancy is obtained (paragraph 1) as well as the control of the influence of the level of the water head on the floatage of platform 1 (paragraph 4). In this connection it is sufficient to point out that, owing to the so shaped floating bodies 8 and 9 the total area occupied by the water on the platform surface 1 is greatly reduced and as a result thereof, the influence on the floatage, due to the change of the level of the water head inside platform 1, is reduced in an equal amount, said changes being compensate, however, by the immersion (with respect of this water head) of a portion of less height of these floating bodies 8 and 9.

After all, also in the limit condition (i.e. when the channels 10 are entirely empty), the weight of the sole floating bodies 8 and 9 (since, the base surface area being maintained equal, it is possible to vary their weight, by varying its height and specific gravity), would be sufficient to ensure the formation of a weir as well as the conveying towards the central suction device of the currents of overflowed liquid.

As far as apron-like flexible wall 4 is concerned, it is to be pointed out that this latter has only the task to connect the inner edge of annular band 3 and the outer peripheral edge of the lower disc 5. Therefore the wall 4 has to be made of a suitable material, preferably a waterproof and easily deformable cloth, as, for instance, a very thin rubber coated fabric, so as to enable the annular member 3, 6 and the disc 5 together with the floating bodies 8 and 9, to freely move without any mutual influence or restraint.

The flexible wall element 4 has to be mounted with some particular artifices, considering that otherwise, a very serious inconvenience could take place, affecting negatively the operation of the apparatus.

In fact, the pressure difference which is created between the outer and the inner surfaces of the flexible wall 4, due to the lowering of the water head inside platform 1, could cause a building of this wall 4 towards the inside and upwards which could also prevent the flowing of the water along the channels 7 towards the inner zone of platform 1, thus stopping the operative cycle. In order to overcome said inconvenience, provision has been made to mount inside the wall 4, in close proximity of its inner surface, a plurality of rigid or semirigid vertical plates 46, each fixed to the inner surface (i.e. to the surface facing the central area of platform 1) of the bodies 6 and which extend downwardly but without reaching the disc 5. Moreover, the apron-like wall 4 could be also provided with an annular pocket **4*a*, provided to receive a suitable annular member 16 designed to impart to the wall 4*a* a radial stiffening; said element 16 could be a steel cable of a sufficiently large diameter. As far as the central suction device is concerned, it is to be noted that in the most simple embodiment shown in FIGS. 1 and 2, this device is generally marked 11 and includes a rigid pipe union 12 having a vertical end portion coaxial to the axis X—X of platform 1, and forming near its upper end a flange 12*a*, extending outwardly, which has to be placed underneath the central opening 5*a* of the disc 5, so that the central part of this latter will be sandwiched between flange 12*a*, and a movable superposed flange or annular ring 12*b* by means of screws or the like. The annular ring 12*b* supports the feet 15 of a floating body 14, which has the task of co-operating to support in floating condition platform 1 and the parts connected thereto, and to prevent the suction of the air through the inlet orifice 12*c* of the pipe union 12, which by means of a flexible pipe 13 is connected to a pump 17, which can be mounted, for instance, ashore and which forms the pumping unit 2 in this embodiment. The operation of the apparatus, according to this embodiment, is the following one. As soon as the pump 17 becomes operative, through the pipes 13 and 12 a suction is created, which produces a lowering of the level of the liquid surface in the inside of platform 1, this causes a lowering of the level of the liquid in the inside of platform 1, and this causes through the weir sill 3*a*, a flowing in of the surface liquid layer on which floats the material, in particular oil which has to be removed. The pump 17 must be so dimensioned that its flow rate is equal to the flow rate of the liquid current overflowing the sill 3*a*, so that the amount of the liquid entering through the sill 3*a* and the one passing through the suction device 11**, are perfectly balanced and the system can operate continuously, without any intermittence.

In FIGS. 3 to 5 is shown a more improved and preferred embodiment. According to this variant, at the centre of platform 1 is mounted a suction device **11*a*, which includes a rigid pipe union 19*a*, the upper end portion of which is vertical and coaxial to the axis X—X of platform 1**.

This pipe **19*a* passes through the central orifice 5*a* of the disc 5 to which is connected by means of a flange 19*b* made integral with the pipe 19*a*, and by a movable flange or flat ring 25 which are locked together by means of screws or the like, the inlet orifice 19*c* of the pipe 19 opening just over the annular ring 25. A rigid pipe union 18*a* of small diameter than that of the pipe union 19*a*, has its upper portion vertical and coaxial to the axis X—X and passes through the wall of the pipe 19*a* with the interposition of seal means and extends upwards over the inlet orifice 19*c*, so as to be spaced away from said orifice 19*c* of a predetermined distance, so that the inlet orifice 18*b* of the pipe 18*a* has a higher level than that of the inlet orifice 19*c*. Just below the orifice 18*b*, a circular plate 26 is fastened to the pipe 18*a*, the plate 26 supporting an upper conical tank 26*a*. From the central portion of the plate 26, inside the tank 26*a*, but about the orifice 18*b* a cylindrical wall 27 extends upwards, which is coaxial to the axis X—X and has a diameter greater than that of the orifice 18*b*. The upper portion of the wall 27 has short longitudinal slots 27*a* cut therein which define therebetween tabs 27*b*; these tabs are slightly vertically bent in order to form a plurality of peripheral small passages, so that the slotted wall 27, 27*a*, 27*b* can act as a spoiler. Over the orifice 18*a* and supported by feet 29 is mounted a plate 28, acting as a screen, so as to prevent whirpool formations and therefore an air suction through the pipe 18*a*. Through plate 26 pass rigid pipes 30, the orifice 30*a* of which open into the tank 26*a*, but on the outside of the cylindrical wall 27. The rigid pipes 30 are made integral with plate 26 as well as with the flat ring 25. The rigid pipes 18*a* and 19*a* are connected by flexible pipes 18 and 19 to the suction orifices 21*a* and 22*a* respectively of pumps 21 and 22, while the rigid pipes 30 are connected by means of a multiway pipe union 20*a* which is connected to the delivery pipe 24 of the pump 22 through a three-way valve 23**.

The pipes 18 and 19, as well as the pipe 13 of the first embodiment, may be supported along their path by at least one floating body 45. The improved device **11*a*** enables to perform a second skimming operation of the polluting floating matter; this second skimming is very useful when very thin oil film layers have to be removed from liquid surfaces.

The operation of the apparatus provided with the improved suction device **11*a*** is as follows:

When, as in the preceding embodiment, the polluted water enters platform 1 owing to the different level of the water head induced by the suction effect and considering that the liquid flow is by no means troubled, so that the oily upper layer will reach the center of platform 1 and then the suction device **11*a* always floating on the water surface and being by no means mixed with water. In short, at the entrance of the suction device 11*a*, enters a liquid flow which is constituted by an upper oily layer and a lower water layer. Then because of the action of the pump 22 which causes a suction effect through the line 19, 19*c* between the inlet orifice 19*c* and the flat plate 26 a underpressure is created, which acts only on the lower water layers, so that only water will be removed, which is present in the lower part of platform 1, while the oily layer floating on the water surface will be sucked and conveyed into a recovery reservoir or the like through the second line 18***a*, 18 which is connected with the pump 21.

The efficiency of this suction device 11*a* is furtherly improved by the provision on the rigid plate 26, of the concave tank 26*a* which promotes the entrance of the oily upper layer into the space just above the central portion of the device 11*a*, where there is the inlet orifice 18*b* of the piping 18*a*, 18. The cylindrical slotted wall 27 serves to promote the collecting of the upper oily layer through its vertical slots 27*a*, only on account of the pressure difference existing between the outer and inner sides of the wall 27.

In order to furtherly improve the efficiency and the adaptability of this system to the different operative conditions, the suction phase of the oil may be timed, so that suction phases can take place at time intervals, separated by working breaks of a greater or smaller duration, during which the oil will be collected at the center of platform 1. The duration of the working periods and of the break periods may be planned by the operator, according to the operative conditions, by means of a suitable control box controlling the operation of the pump 21, according to a predetermined program.

In order to obtain an intermittent working of the pump 21, any suitable known technique can be used.

The invention also provides the possibility of performing a washing in countercurrent of the device 11*a*, so as to prevent the clogging thereof by solid materials, such as paper, plastics, algae and the like, which could be present on the liquid surface. For such a purpose, a big tube 31 of a considerable diameter shaped in the form of an inverted U and provided with a flared inlet orifice 31*a*, is mounted over the upper orifices of the pipes 30.

The tube 31 is supported by brackets 32*a*, 32*b* which are mounted on one of the flaoting bodies 9. The discharge orifice 31*b* of the tube 31 opens over a net or perforated basket or the like 33, mounted on the upper surface of the same floating body 9, supporting the brackets 32*a*, 32*b*.

The operation of this washing system is as follows:

When the washing phase must take place, during a stopping period of the pump 21, the three-way valve 23 mounted on the delivery pipe 24, changes over under a manual control or an automated control, according to a program of the control box, so that the pressurized water flow, delivered by the pump 22, is conveyed in to the pipe line 20 and then through the three-way pipe union through the pipe 30, passing through the flanges 19*b* and 25 and thence through the plate 26, flowing out from the orifices 30*a* within the tank 26*b*.

Thus, strong water jets flow out of the pipes 30 passing across the liquid collected in the central zone of platform 1, so that a washing is carried out of liquid mass collected therein, said water jets collecting and dragging together the solid substances present in this liquid mass and entering the large tube 31, which guides the liquid current together with the collected solid materials suspended therein up to let it falls down into the perforated basket 33 from which the water can freely flow out, while the solid materials are kept back.

What we claim is:

1. An apparatus for separating and removing polluting liquid or slimes floating on water or other liquid surface which comprises:

a flexible floating platform of a substantially circular form having a specific gravity less than that of the water or other liquid surface, at a center of which a free space is arranged in which a suction device is mounted, said platform consisting of an annular outer floating member comprising an annular flexible band having a peripheral weir lip and supported by a plurality of floating bodies spaced apart from each other so as to define therebetween radial channels and so shaped, constructed and dimensioned as to maintain the weir lip at a predetermined depth, and of a central flexible circular plate supported by a plurality of floating members so positioned as to define a pluraliy of substantially radial channels in fluid flow communication of the first plurality of outer entrance channels, as well as a central free space, the peripheral annular outer floating part and the central floating part of the platform being connected to one another by an annular skirt flexible member so as to form in the platform two independent floating systems and;

a suction unit mounted within the central free space of the platform and including at least a rigid suction pipe, the inlet orifice of which is positioned just over the bottom of the platfrom and coaxially with the vertical axis X—X thereof, the suction pipe being connected through a flexible pipe, to a pumping unit mounted on a remote supporting element.

2. An apparatus according to claim 1, wherein the suction device includes a rigid pipe having a vertical portion which opens in the center of the platform just over the bottom disc and which is connected by a flexible pipe with a pump forming the pumping unit, over the inlet orifice of this rigid pipe a floating body is mounted in the inside of the suction device, being spaced apart from the inlet orifice by a plurality of feet.

3. An apparatus according to claim 1 wherein the pumping unit is mounted ashore or on a boat, raft or lighter.

4. An apparatus according to claim 1, wherein the peripheral annular band is made of flexible material having a peripheral edge slightly extending upwardly, so as to form a weir sill, the plurality of floating bodies mounted on the peripheral band have tapered outer ends, so as to act as cut-water means and substantially radial side surfaces, these floating bodies being angularly spaced apart from each other, so as to define therebetween first radial channel portions; wherein the skirt flexible wall depending from the inner edge of the peripheral band is made of a waterproof material and is stiffened by vertical wall elements, each fixed to the inner side of some of the floating bodies supported by the peripheral band, and extending downwards less than the apron-like wall; and wherein the floating bodies of the central part of the platform comprise two plurality of floating bodies, one of which is mounted near the periphery of the disc and the other in its intermediate other portion, the floating bodies of the first and second pluralities defining in combination the second inner portions of the channels designed to convey the polluted water from the periphery of the platform to its central free space, where the suction device is mounted.

5. An apparatus for separating and removing exclusively by mechanical means, a polluting liquid or slimes floating on water or another liquid not miscible with the polluting substances, characterized by the fact that it comprises:

a flexible floating platform of a substantially circular shape, having a specific gravity less than that of the water, at the center of which a free space is arranged, in which a suction device is mounted, the platform having a plurality of channels with entrance orifices arranged on the periphery thereof and provided with a weir sill on said entrance orifices, said channels having radial outer portions and inner portions ending into the free central space of the platform which is made of such materials and is so dimensioned as to maintain the peripheral weir sill, in any operative condition, always spaced underneath the water surface;

a suction unit mounted within the central free space of the platform and including at least a rigid suction pipe, the inlet orifice of which is positioned just over the bottom of the platform and coaxially with the vertical axis X—X thereof, the suction pipe being connected through a flexible pipe, to a pumping unit mounted on a remote supporting element, wherein the platform comprises:

a semirigid peripheral annular band made of flexible material, having a peripheral edge slightly extending upwards, so as to form a weir sill, a plurality of floating bodies mounted on the peripheral band and having tapered outer ends, so as to act as cut-water means and substantially radial side surfaces, these floating bodies being angularly spaced apart from each other, so as to define therebetween first radial channel portions;

an apron-like flexible wall depending from the inner edge of the peripheral band and made of a waterproof material and stiffened by vertical wall elements, each fixed to the inner side of some of the floating bodies supported by the peripheral band, and extending downwards less than the apron-like wall;

a semirigid lower disc connected to the lower edge of the apron-like wall and provided with a central orifice on which the suction device is mounted; and two pluralities of floating bodies one of the two plurality of which is mounted near the periphery of the disc and the other ones in its intermediate other portion, the floating bodies of the first and second pluralities defining in combination the second inner portions of the channels designed to convey the water from the periphery of the platform to its central free space, where the suction device is mounted.

6. An apparatus for separating and removing exclusively by mechanical means, a pollution liquid or slimes floating on water or another liquid not miscible with the polluting substances, characterized by the fact that it comprises:

a flexible floating platform of a substantially circular shape, having a specific gravity less than that of the water, at the center of which a free space is arranged, in which a suction device is mounted, the platform having a plurality of channels with entrance orifices arranged on the periphery thereof and provided with a weir sill on said entrance orifices, said channels having radial outer portions and inner portions ending into the free central space of the platform which is made of such materials and is so dimensioned as to maintain the peripheral weir sill, in any operative condition, always spaced underneath the water surface;

a suction unit mounted within the central free space of the platform and including at least a rigid suction pipe, the inlet orifice of which is positioned just over the bottom of the platform and coaxially with the vertical axis X—X thereof, the suction pipe being connected through a flexible pipe, to a pumping unit mounted on a remote supporting element, wherein the suction device comprises a first rigid short pipe having a vertical portion which opens just over the bottom disc of the platform and which is connected through a flexible pipe to a first pump designed to suck water and to discharge it into the water spot through a delivery pipe;

a second rigid pipe of a smaller diameter than that of the first rigid pipe and which has a vertical portion seal passing through the vertical portion of the first pipe and extending upwardly beyond the inlet orifice of this latter of a predetermined distance passing through a horizontal plate made integral with this second pipe, and the inlet orifice of the second pipe being placed just over this plate, which also supports a conical tank as well as a cylindrical vertical wall arranged within the conical tank and about the inlet orifice of the second pipe this cylindrical wall having longitudinally slotted upper edge, these slots forming passages for the polluting liquid or slime, within the cylindrical wall and over the inlet orifice of the second pipe being mounted, by means of spacing feet, a plate designed to screen this inlet orifice so as to prevent any entrance of air, the second pipe being connected by a flexible pipe to a second pump designed to recover the polluting liquid or slime.

7. An apparatus according to claims 1 or 6 wherein from the delivery pipe of the first pump through a three-way valve a flexible pipe is branched off, which is connected through a multi-way joint, to rigid substantially vertical washing pipes, seal traversing the disc bottom of the platform as well as the plate which is supported by the second pipe so that these washing pipes open within the conical tank on the outside of the cylindrical slotted surface, washing pipes, which are provided to convey pressurized water jets into the suction device while over the suction device is mounted a duct having a flared entrance orifice of such a diameter as to be able to receive the water jets and the solid material dragged therein from the liquid mass contained in the suction device, this duct having the shape of an inverted U, and being supported by brackets carried on one of the floating bodies mounted on the intermediate portion of the platform and fixed to the lower bottom disc the discharge orifice of this duct opening on a perforated basket or the like, mounted on a floating body of the second pluralities of floating bodies.

* * * * *